US007712234B2

(12) United States Patent
Striegel

(10) Patent No.: US 7,712,234 B2
(45) Date of Patent: May 11, 2010

(54) TRENCH WALL RIPPER APPARATUS

(76) Inventor: Monte G. Striegel, 50 N. County Rd. 650 W., Medora, IN (US) 47260

( * ) Notice: Subject to any disclaimer, the term of this patent is extended or adjusted under 35 U.S.C. 154(b) by 1094 days.

(21) Appl. No.: 11/093,464

(22) Filed: Mar. 30, 2005

(65) Prior Publication Data

US 2006/0225312 A1 Oct. 12, 2006

(51) Int. Cl.
*E01H 3/00* (2006.01)

(52) U.S. Cl. ..... 37/444; 37/468; 37/404; 37/903; 172/862

(58) Field of Classification Search ..... 37/403, 37/468, 404, 405, 406, 407, 444, 446, 448; 414/722; 172/713, 762, 766, 540, 553; 299/79.1, 299/110, 39.8
See application file for complete search history.

(56) References Cited

U.S. PATENT DOCUMENTS 203,042 A * 4/1878 Hill ..... 37/366
1,580,725 A * 4/1926 Harrison ..... 37/448
1,648,783 A * 11/1927 Rosselle ..... 37/448
1,783,831 A * 12/1930 Downie ..... 414/726
1,910,290 A * 5/1933 Johnson ..... 172/688
2,353,685 A * 7/1944 Askue ..... 37/450
2,660,323 A * 11/1953 Carlesimo ..... 37/444
2,732,639 A * 1/1956 Lillengreen ..... 172/701.2
2,841,897 A * 7/1958 Duke ..... 172/815
2,965,989 A * 12/1960 Hibbard ..... 172/701.2
3,029,534 A * 4/1962 Rakisits ..... 172/701.2
3,038,267 A * 6/1962 Helton et. al. ..... 172/777
3,089,261 A 5/1963 Flath
3,093,917 A * 6/1963 Schroeder ..... 37/444
3,403,940 A 10/1968 Clark
3,456,370 A * 7/1969 Gilbertson ..... 172/701.2
3,531,161 A * 9/1970 Conn ..... 299/18
3,621,594 A * 11/1971 Hahn ..... 37/451
3,638,736 A * 2/1972 Hahn ..... 172/701.2
3,653,133 A * 4/1972 Black et al. ..... 37/450
3,724,899 A 4/1973 Clark
3,748,762 A * 7/1973 Tarrant ..... 37/448
3,792,539 A * 2/1974 Clark ..... 37/448
3,841,709 A * 10/1974 Kniff ..... 299/101
3,851,413 A * 12/1974 Lukavich ..... 37/451
3,958,347 A * 5/1976 Heitman ..... 37/379
3,961,788 A * 6/1976 Helton et al. ..... 172/701.2
4,007,550 A * 2/1977 Stepe ..... 37/448
4,047,312 A * 9/1977 Stepe ..... 37/448
4,069,604 A * 1/1978 Stepe ..... 37/448
4,071,967 A * 2/1978 Klett ..... 37/448
4,074,449 A * 2/1978 Lanz et al. ..... 228/114
4,086,967 A * 5/1978 Eftefield et al. ..... 172/777
4,128,132 A * 12/1978 Moen et al. ..... 172/747
4,129,952 A * 12/1978 Olson ..... 37/444
4,151,664 A 5/1979 Maura
4,187,626 A * 2/1980 Greer et al. ..... 37/453
4,189,907 A * 2/1980 Erdman ..... 56/400

(Continued)

FOREIGN PATENT DOCUMENTS

EP 0 280 003 8/1988

(Continued)

*Primary Examiner*—Thomas A Beach
(74) *Attorney, Agent, or Firm*—Baker & Daniels LLP

(57) ABSTRACT

An apparatus coupled to an excavation bucket for creating a trench sidewall having indentations formed therein.

16 Claims, 5 Drawing Sheets

U.S. PATENT DOCUMENTS

| | | | | | |
|---|---|---|---|---|---|
| 4,208,817 | A | * | 6/1980 | Merkel | 37/448 |
| 4,279,085 | A | * | 7/1981 | Arnold | 37/444 |
| 4,290,214 | A | * | 9/1981 | Stepe | 37/448 |
| 4,315,375 | A | * | 2/1982 | Shinn | 37/460 |
| 4,329,794 | A | | 5/1982 | Rogers | |
| 4,457,085 | A | | 7/1984 | Arnold | |
| 4,547,985 | A | * | 10/1985 | Silins et al. | 37/444 |
| 4,550,513 | A | * | 11/1985 | Rasmussen | 37/448 |
| 4,719,711 | A | * | 1/1988 | Sieber et al. | 37/444 |
| 4,784,517 | A | * | 11/1988 | Bergqvist et al. | 404/75 |
| 4,891,893 | A | * | 1/1990 | Bowes, Jr. | 37/328 |
| 4,896,444 | A | | 1/1990 | Sieber et al. | |
| 5,400,531 | A | | 3/1995 | Brown | |
| 5,407,013 | A | * | 4/1995 | Scott | 172/762 |
| 5,647,448 | A | * | 7/1997 | Skaggs | 175/421 |
| 5,842,747 | A | * | 12/1998 | Winchester | 299/87.1 |
| 5,901,480 | A | | 5/1999 | Shamblin | |
| 6,070,345 | A | * | 6/2000 | Akaki et al. | 37/407 |
| 6,186,735 | B1 | * | 2/2001 | Deyo et al. | 414/722 |
| 6,213,559 | B1 | * | 4/2001 | Stevens | 299/36.1 |
| 6,450,269 | B1 | * | 9/2002 | Wentworth et al. | 175/61 |
| 6,799,385 | B2 | * | 10/2004 | Champney | 37/451 |
| 7,275,338 | B2 | * | 10/2007 | LaHood | 37/449 |
| 2003/0066215 | A1 | * | 4/2003 | Grant | 37/446 |
| 2003/0198520 | A1 | | 10/2003 | Evans | |
| 2005/0284006 | A1 | * | 12/2005 | Jones | 37/446 |

FOREIGN PATENT DOCUMENTS

| | | | | |
|---|---|---|---|---|
| JP | 59106629 | A | * | 6/1984 |
| WO | WO 00/55434 | | | 9/2000 |

* cited by examiner

TRENCH WALL RIPPER APPARATUS

BACKGROUND AND SUMMARY OF THE INVENTION

The present invention relates to an excavation bucket and, more particularly, to a ripper apparatus coupled to an excavation bucket and configured to create indentations in a trench wall.

Excavation buckets of the type used with backhoes are well-known in the art. Such excavation buckets are often used to dig trenches, for example, in connection with septic systems. Conventional excavation buckets provide for substantially smooth vertical sidewalls in the trench. However, it is desirable, particularly in connection with septic systems, to provide a plurality of grooves or indentations within the trench sidewalls in order to increase the surface area thereof, thereby providing for more efficient absorption by the sidewalls and improving efficiency of the septic system.

Furthermore, particularly when digging trenches in soil with high moisture content, conventional excavation buckets will smear or compact the soil of the trench sidewalls. As such, absorption efficiency of the resulting septic system is reduced. Breaking-up the sidewalls not only increases the absorption surface area but improves the porosity of soil, thereby facilitating improved absorption and improving efficiency of the septic system.

According to an illustrative embodiment of the present invention, an excavation bucket is configured to form a trench, the bucket including a first sidewall, and a second sidewall positioned in spaced relation to the first sidewall. A bottom portion connects the first sidewall and the second sidewall. A ripper apparatus is releasably attached to the first sidewall. The ripper apparatus includes a mounting member, a coupler configured to releasably attach the mounting member to the first sidewall, and a plurality of cutters extending outwardly from the mounting member and configured to create indentations in a sidewall of the trench formed by the bucket.

According to a further illustrative embodiment of the present invention, a ripper apparatus kit is provided for attachment to an excavation bucket. The ripper apparatus kit includes a mounting member, and a plurality of cutters configured to be supported by the mounting member and to extend outwardly therefrom. A coupler is configured to releasably secure the mounting member to the excavation bucket.

According to another illustrative embodiment of the present invention, a cutter is configured to be removably supported by an excavation bucket. The cutter includes a cylindrical base portion, and a plurality of longitudinally extending splines supported by the base portion. A cutting portion is supported by the base portion.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1:
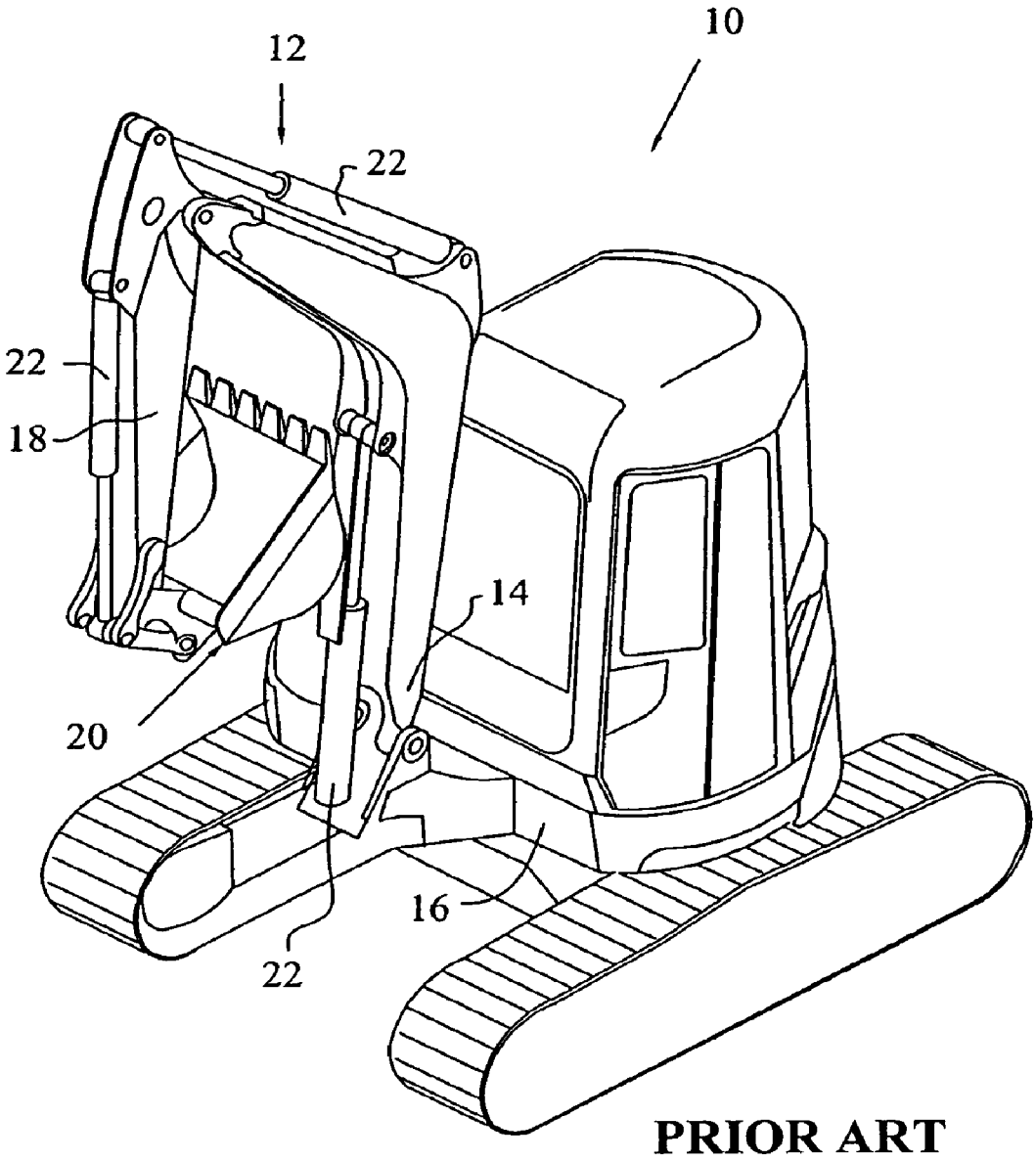
PRIOR ART FIG. 1
FIG. 1 is a perspective view of a backhoe including a conventional excavation bucket.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms and such exemplification is not to be construed as limiting the scope of the invention in any manner.

DESCRIPTION OF INVENTION

The embodiments discussed below are not intended to be exhaustive or limit the invention to the precise forms disclosed in the following detailed description. Rather, the embodiments are chosen and described so that others skilled in the art may utilize their teachings.

With reference initially to FIG. 1, a conventional backhoe 10 is illustrated as including a movable support arm 12 having a first end 14 coupled to an operator platform 16. A second end 18 of the support arm 12 is operably coupled to an excavation bucket 20. As is known in the art, the arm 12 is configured to be moved both vertically and horizontally through conventional actuators, such as hydraulic cylinders 22. Operation of the hydraulic cylinders 22 is controlled by an operator interface (not shown) supported by the operator platform 16.

Figure 2:
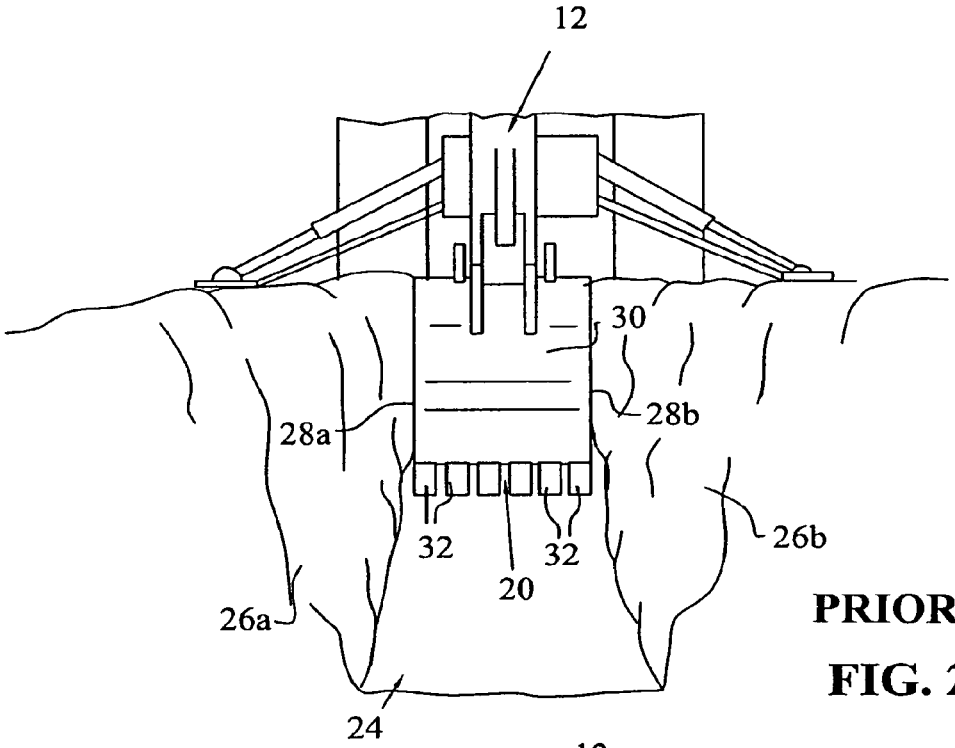
PRIOR ART FIG. 2
FIG. 2 is a front elevational view of the excavation bucket of FIG. 1 digging a trench.

As shown in FIG. 2, the excavation bucket 20 may be controlled through operation of the arm 12 in order to dig or form a trench 24 having opposing vertical sidewalls 26*a*, 26*b*. The excavation bucket 20 includes a first sidewall 28*a* and a second sidewall 28*b*. A bottom portion 30 connects the first sidewall 28*a* to the second sidewall 28*b*. A plurality of cutting teeth 32 extend outwardly from the bottom portion 30 and are illustratively formed of hardened steel. As is known in the art, the cutting teeth 32 facilitates digging, particularly through hard soil, clay, and rocks.

Figure 3:
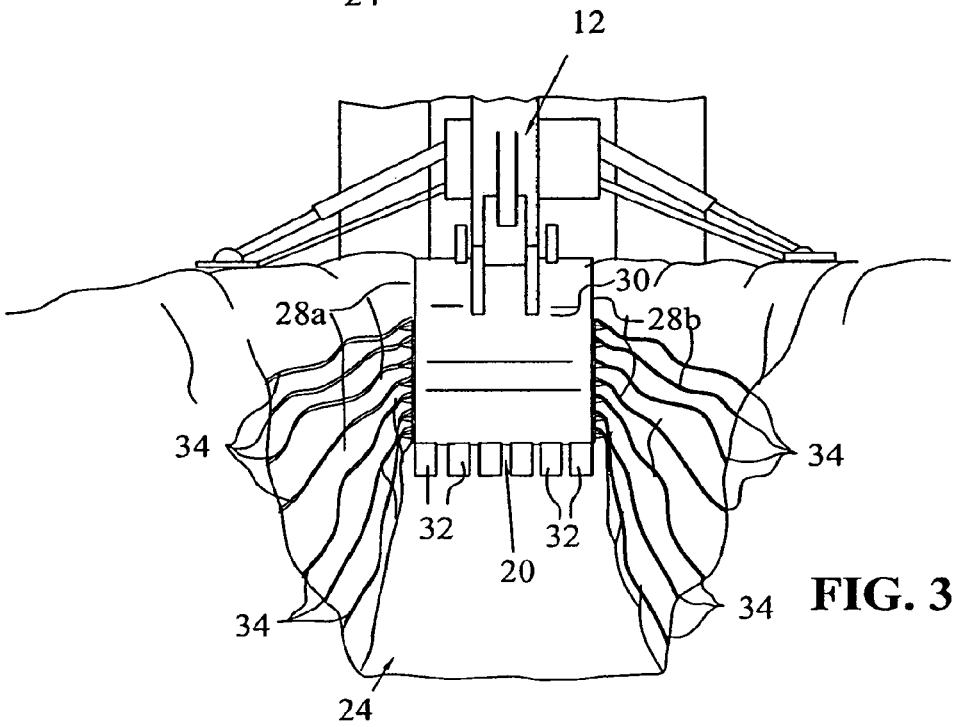
FIG. 3 is a front elevation view similar to FIG. 2, showing the excavation bucket with the illustrative embodiment ripper apparatus of the present invention coupled thereto for forming a plurality of indentations within the opposing sidewalls of the trench.
Figure 4:
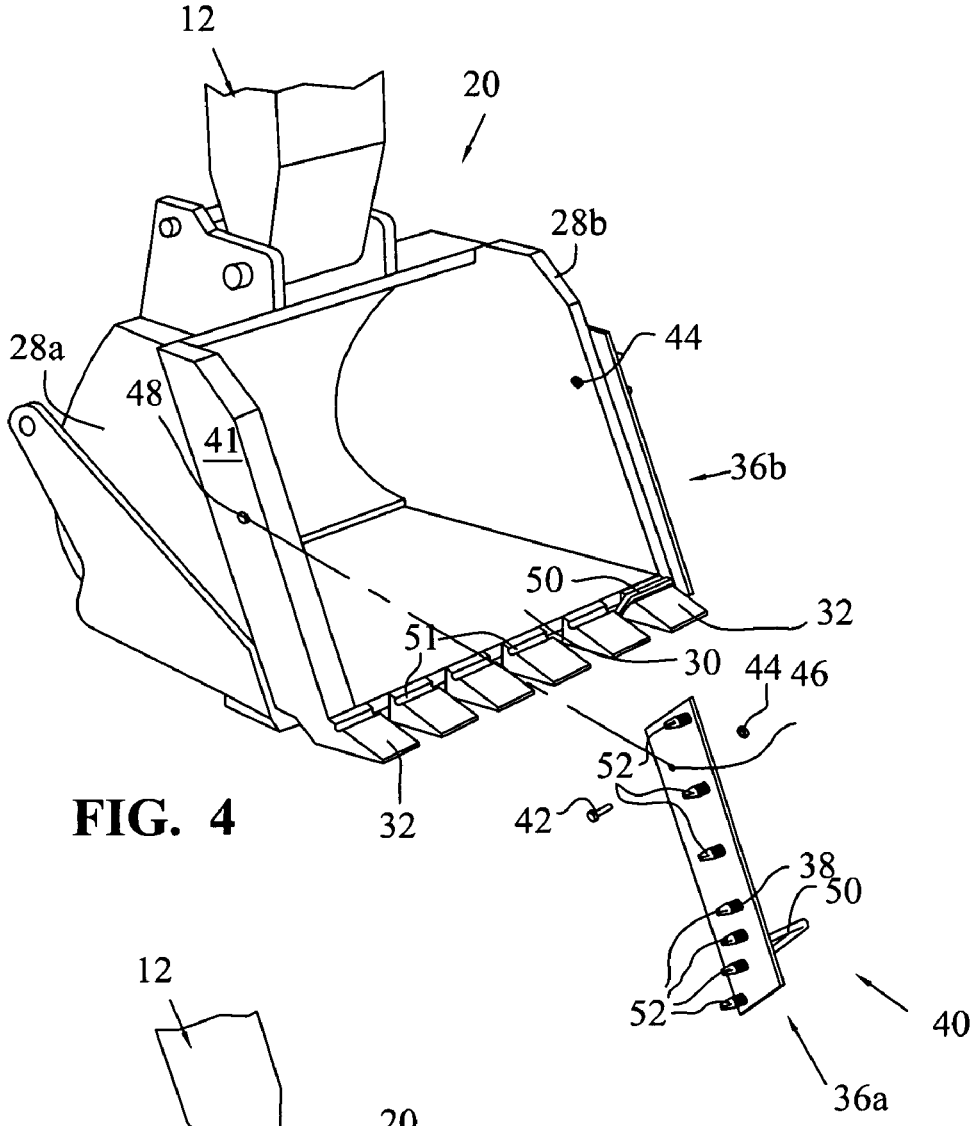
FIG. 4 is a perspective view of the excavation bucket of FIG. 1, with the illustrative embodiment ripper apparatus of the present invention positioned in spaced relation thereto.
Figure 5:
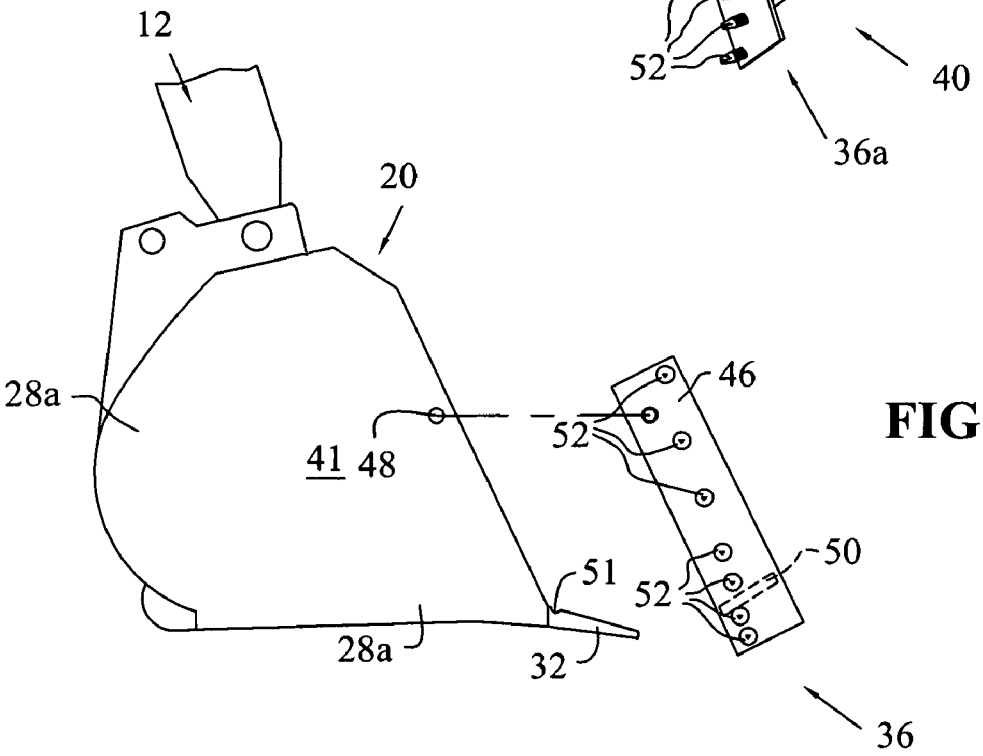
FIG. 5 is a side elevational view of the excavation bucket and the ripper apparatus of FIG. 4.

As shown in FIG. 2, the sidewalls 26*a*, 26*b* of the trench 24 formed by the excavation bucket 20 are substantially smooth or planar. As noted above, the soil in the sidewalls 26*a*, 26*b* is often smeared or compacted, particularly if the soil has a high moisture content. In order to facilitate absorption and to provide for an efficient septic system, a plurality of indentations, channels, or grooves 34 break-up the substantially smooth sidewalls 26*a*, 26*b*. The plurality of indentations 34 together provide a corrugated appearance to the respective sidewalls 26*a*, 26*b* as shown in FIG. 3.

Figure 6:
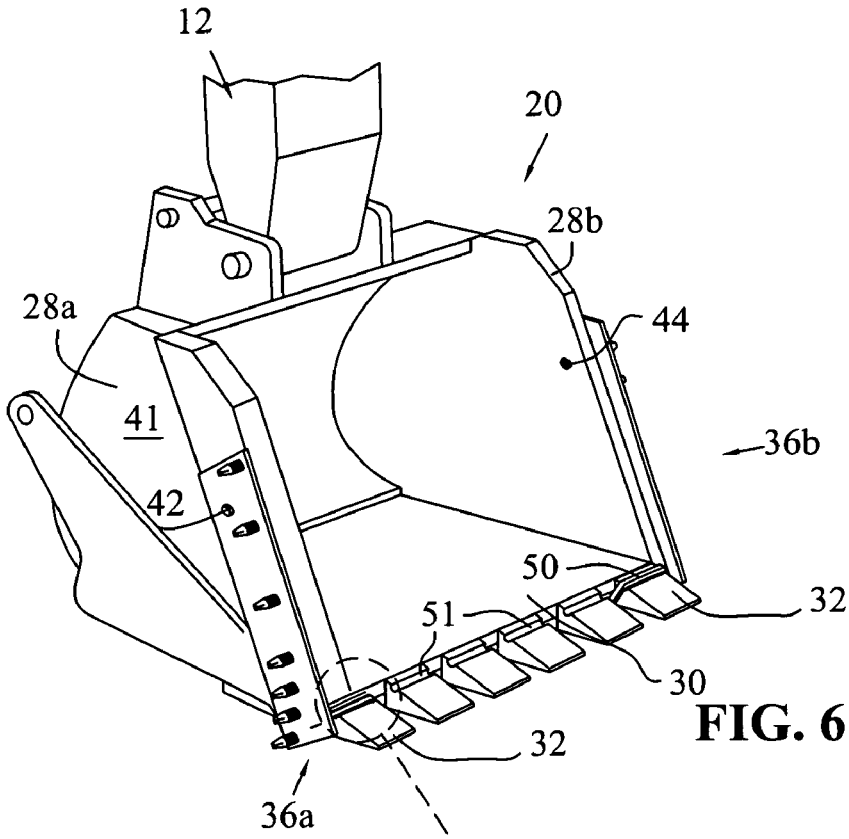
FIG. 6 is a perspective view of the excavation bucket of FIG. 1, with the illustrative embodiment ripper apparatus of the present invention coupled thereto.
Figure 6A:
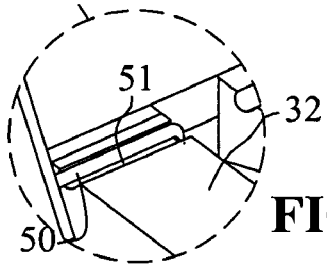
FIG. 6A is a detail view of FIG. 6.
Figure 7:
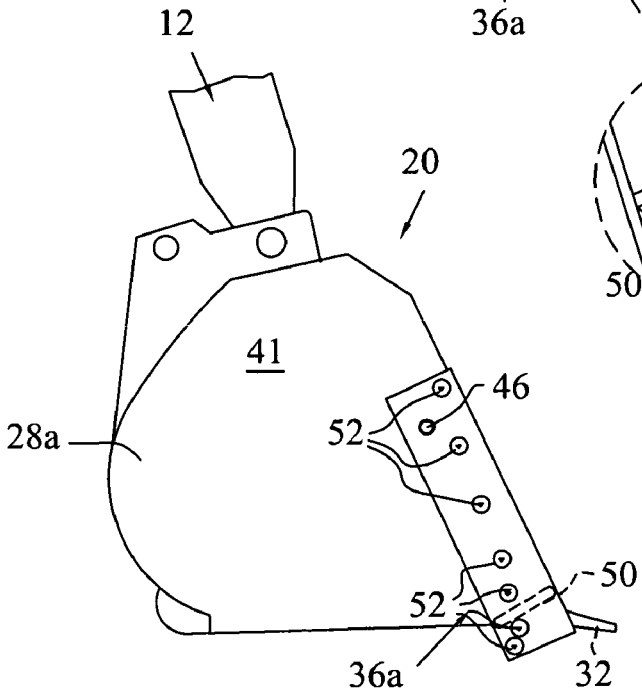
FIG. 7 is a side elevational view of the excavation bucket and the ripper apparatus of FIG. 6.
Figure 9:
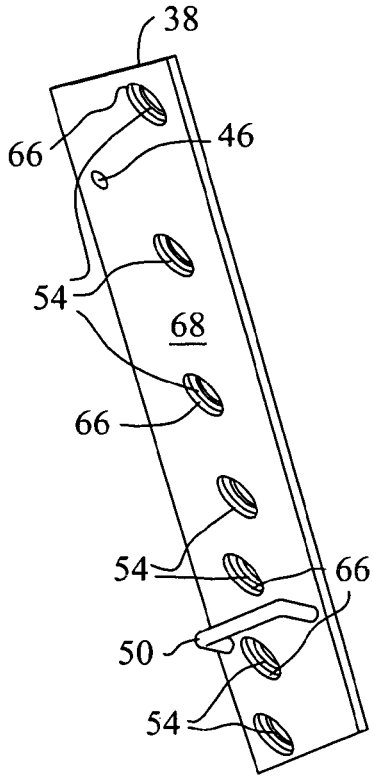
FIG. 9 is rear perspective view of the mounting member of the ripper apparatus of FIG. 8.

With reference now to FIGS. 4-7, in the illustrative embodiment of the present invention, a ripper apparatus 36*a*, 36*b* is removably coupled to each sidewall 28*a*, 28*b* of the excavation bucket 20. Each ripper apparatus 36 includes a mounting member 38 and a coupler 40 configured to releasably attach the mounting member 38 to an outer surface 41 of a respective sidewall 28*a*, 28*b*. Illustratively, the coupler 40 includes a fastener such as a conventional bolt 42 configured to threadably couple with a nut 44. More particularly, the bolt 42 passes through an opening 46 in the mounting member 38 and an opening 48 within the excavation bucket sidewall 28 to provide a first or upper securing point for the mounting member 38. The coupler 40 further includes a loop 50 which is configured to receive an outer cutting tooth 32 of the excavation bucket 20, thereby providing a second or lower securing point. As shown in FIGS. 6, 6A and 9, the loop 50 is substantially D-shaped and is configured to rest within a recess 51 formed in the respective cutting tooth 32.

Figure 8:
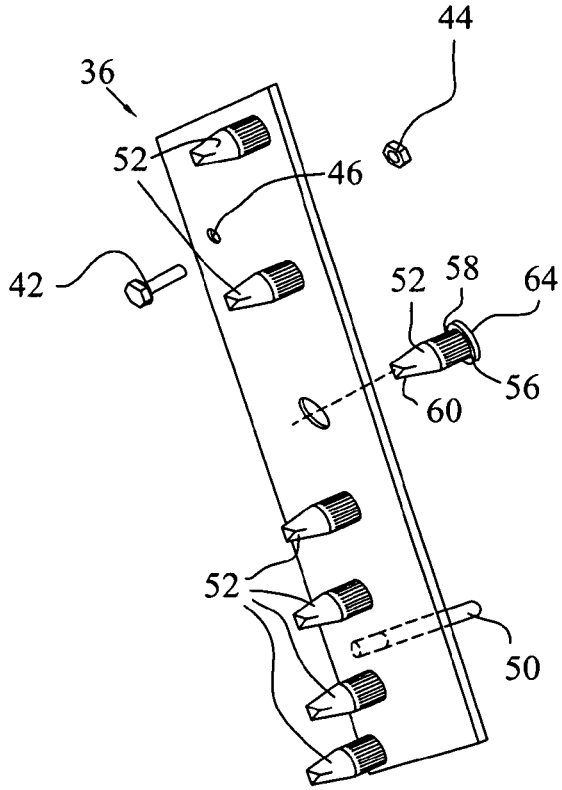
FIG. 8 is a partially exploded front perspective view of the illustrative embodiment ripper apparatus of the present invention.
Figure 10:
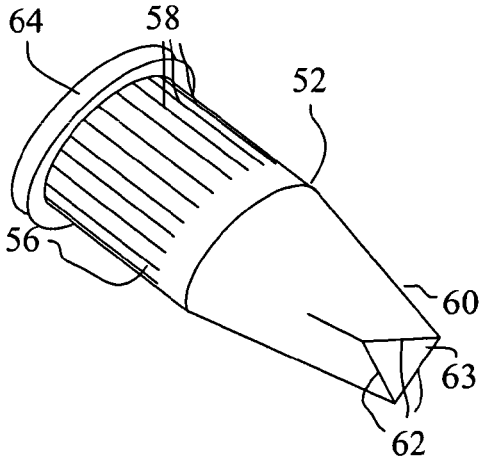
FIG. 10 is a perspective view of an illustrative embodiment cutter of the ripper apparatus of FIG. 8.

A plurality of cutters 52 are removably supported within the mounting member 38. With reference now to FIGS. 8-10, the mounting member 38 illustratively includes a substantially planar plate having a plurality of openings 54 formed therein. The openings 54 are configured to removably receive the cutters 52. As such, the cutters 52 may be easily inserted and removed as needed for maintenance and replacement. Illustratively, both the mounting member 38 and the cutters 52 are formed of a strong, durable material, such as hardened steel.

As shown in FIGS. 8 and 10, each cutter 52 includes a base portion 56, illustratively cylindrical or conical shaped, supporting a plurality of longitudinally extending, circumferentially spaced compression splines 58. The compression splines 58 are configured to be press fit within the openings 54 of the mounting member 38. In other words, the outer diameter collectively formed by the compression splines 58 is slightly greater than the diameter of the openings 54. A tapered cutting portion 60 is supported by the base portion 56 and illustratively includes a plurality of cutting edges 62. In the illustrative embodiment, a total of three cutting edges 62 are provided, thereby forming a triangular cutting point 63. The triangular cutting point 63 provides for improved cutting and stability, while providing for consistent cutting regardless of the orientation of the excavation bucket 20. It should be appreciated that the number and orientation of the cutting edges 62 may be varied without altering the scope of the invention. An enlarged foot 64 supports the base portion 56 and is configured to be received within a counterbore 66 formed on an inner surface 68 of the mounting member 38, so that the foot 64 is flush with the inner surface 68 (FIG. 9).

To install the ripper apparatus 36 of the present invention, opening 48 is formed within the respective sidewall 28 of the excavation bucket 20. Next, the individual cutters 52 are press fit within the openings 54 of the mounting member 38. More particularly, the cutting portions 60 are inserted through the openings on the inner surface 68 such that the compression splines 58 secure the cutters 52 in position, and the foot 64 is received within the counterbore 66. Next, the loop 50 of the mounting member 38 is received over the outer cutting tooth 32 (closest to the respective sidewall 28) of the bucket 20 and placed within recess 51. The bolt 42 is then passed through the openings 46 and 48 and the nut 44 secured thereto. The ripper apparatus 36 is now in position for operation. The ripper apparatus 36 may be removed by merely reversing the above-described process.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. An excavation bucket configured to form a trench, the bucket comprising:

a longitudinally extending first sidewall;

a longitudinally extending second sidewall positioned in spaced relation to the first sidewall;

a bottom portion connecting the first sidewall and the second sidewall;

a plurality of longitudinally extending cutting teeth supported by the bottom portion; and a ripper apparatus releasably attached to the first sidewall, the ripper apparatus including a mounting member having an inner surface and an outer surface, a coupler configured to releasably attach the mounting member to the first sidewall such that the inner surface of the mounting member faces an outer surface of the first sidewall, and a plurality of cuff ers inserted from the inner surface of the mounting member and extending through openings within the mounting member, each of the plurality of cutters having at least one compression surface defining an outer dimension greater than an inner dimension of the opening of the mounting member receiving the cutter such that the cutters are compression fit within the openings of the mounting member, the plurality of cutters extending laterally outwardly from the outer surface of the mounting member in a direction substantially perpendicular to the outer surface of the first sidewall, the plurality of cutters being configured to create indentations in a sidewall of the trench formed by the bucket.

2. The bucket of claim 1, wherein the coupler includes a fastener extending through an aperture formed within the first sidewall.

3. The bucket of claim 2, wherein the coupler further includes a loop receiving one of the cutting teeth.

4. The bucket of claim 1, wherein the plurality of cutters are removably supported by the mounting member.

5. The bucket of claim 1, wherein the at least one compression surface is defined by a plurality of circumferentially spaced compression splines.

6. The bucket of claim 5, wherein the plurality of compression splines collectively define an outer diameter greater than the diameter of the opening within the mounting member.

7. The bucket of claim 1, wherein each of the plurality of cutters includes a base portion and a three-point cuffing portion supported by the base portion.

8. A ripper apparatus kit for attachment to an excavation bucket, the ripper apparatus kit comprising:

a mounting member including a plurality of through holes extending between inner and outer surfaces;

a plurality of cutters configured to be removably supported within the holes of the mounting member by being inserted from the inner surface of the mounting member and to extend outwardly from an outer surface of the mounting member, each of the plurality of cutters having at least one compression surface defining an outer dimension greater than an inner dimension of the opening of the mounting member receiving the cutter such that the cutters are compression fit within the openings of the mounting member; and a coupler configured to releasably secure the mounting member to the excavation bucket.

9. The ripper apparatus kit of claim 8, wherein the coupler includes a fastener configured to extend through an aperture formed within the mounting member, and a loop configured to receive a cutting tooth of the bucket.

10. The ripper apparatus kit of claim 8, wherein the at least one compression surface is defined by a plurality of circumferentially spaced compression splines.

11. The ripper apparatus kit of claim 10, wherein the plurality of compression splines collectively define an outer diameter greater than the diameter of the opening within the mounting member.

12. The ripper apparatus kit of claim 8, wherein each of the plurality of cuff ers includes a base portion and a three-edge cuffing portion supported by the base portion.

13. A ripper apparatus kit for attachment to an excavation bucket, the ripper apparatus kit comprising:

a mounting member including an inner surface, an outer surface, and a plurality of openings extending through the mounting member from the inner surface to the outer surface; and a plurality of cutters supported by the mounting member, the plurality of cutters being insertable and removable from the inner surface of the mounting member and extending through the plurality of openings beyond the outer surface of the mounting member, the cutters secured to the mounting member independent of the bucket;

a coupler configured to releasably secure the mounting member to the excavation bucket, the coupler spaced apart and independent from the plurality of cutters; and wherein the cutters each include a plurality of circumferentially spaced compression splines configured to directly interface in a compression fit relationship within an opening of the mounting member, and a plurality of cutting edges extending outwardly away from the outer surface of the mounting member.

14. The ripper apparatus kit of claim 13, wherein the coupler includes a fastener configured to extend through an aperture formed within the mounting member, and a loop configured to receive a cutting tooth of the bucket.

15. The ripper apparatus kit of claim 13, wherein each of the plurality of cutters includes a foot supporting the plurality of cutting edges and configured to be received within a counterbore formed within the inner surface of the mounting member.

16. An excavation bucket configured to form a trench, the bucket comprising:

a longitudinally extending first sidewall;

a longitudinally extending second sidewall positioned in spaced relation to the first sidewall;

a bottom portion connecting the first sidewall and the second sidewall;

a plurality of longitudinally extending teeth supported by the bottom portion;

a first mounting member releasably coupled to the first sidewall and having a plurality of openings and an inner surface facing an outer surface of the first sidewall;

a plurality of first cutters extending laterally outwardly from the first mounting member in a first direction substantially perpendicular to the outer surface of the first sidewall, each of the plurality of first cutters having at least one compression surface defining an outer dimension greater than an inner dimension of the opening of the first mounting member receiving the first cutter such that the first cutters are compression fit within the openings of the first mounting member, the plurality of first cutters being configured to create indentations in a first wall of a trench formed by the bucket;

a second mounting member releasably coupled to the second sidewall and having a plurality of openings and an inner surface facing an outer surface of the second sidewall; and a plurality of second cutters extending laterally outwardly from the second mounting member in a second direction opposite the first direction and substantially perpendicular to the outer surface of the second sidewall, each of the plurality of second cuff ers having at least one compression surface defining an outer dimension greater than an inner dimension of the opening of the second mounting member receiving the second cutter such that the second cutters are compression fit within the openings of the second mounting member, the plurality of second cutters being configured to create indentations in a second wall of a trench being formed by the bucket; and wherein the plurality of first cutters are inserted from the inner surface of the first mounting member and extend outwardly from the outer surface of the first mounting member, and the plurality of second cuff ers are inserted form the inner surface of the second mounting member and extend outwardly from the outer surface of the second mounting member.

* * * * *

UNITED STATES PATENT AND TRADEMARK OFFICE

CERTIFICATE OF CORRECTION

PATENT NO. : 7,712,234 B2
APPLICATION NO. : 11/093464
DATED : May 11, 2010
INVENTOR(S) : Monte G. Striegel It is certified that error appears in the above-identified patent and that said Letters Patent is hereby corrected as shown below:

In claim 1, Col. 4, in line 25, "cuff ers" should be --cutters--.

In claim 7, Col. 4, in line 52, "cuffing" should be --cutting--.

In claim 12, Col. 5, in line 15, "cuff ers" should be --cutters--, and at line 16, "cuffing" should be --cutting--.

In claim 16, Col. 6, in line 32, "cuff ers" should be --cutters--, in line 43, "cuff ers" should be --cutters--, and in line 44, "form" should be --from--.

Signed and Sealed this

Twenty-ninth Day of June, 2010

David J. Kappos

David J. Kappos
*Director of the United States Patent and Trademark Office*